US008215221B2

(12) United States Patent
Lawitzke et al.

(10) Patent No.: US 8,215,221 B2
(45) Date of Patent: Jul. 10, 2012

(54) GUN BARREL

(75) Inventors: Klaus Lawitzke, Magdeburg (DE); Ralf-Joachim Herrmann, Senzig (DE); Bernhard Scheideler, Beverungen (DE); Heiner Schmees, Celle (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 278 days.

(21) Appl. No.: 12/492,349

(22) Filed: Jun. 26, 2009

(65) Prior Publication Data

US 2009/0320673 A1 Dec. 31, 2009

(30) Foreign Application Priority Data

Jun. 27, 2008 (DE) ..... 10 2008 030 143

(51) Int. Cl.
*F41A 21/00* (2006.01)

(52) U.S. Cl. ..... 89/14.7; 89/14.05; 42/76.01

(58) Field of Classification Search ..... 89/14.7, 89/14.05; 42/76.01, 76.02, 78
See application file for complete search history.

(56) References Cited

U.S. PATENT DOCUMENTS

| | | | | | |
|---|---|---|---|---|---|
| 529,455 | A | * | 11/1894 | Marlin | 42/75.02 |
| 616,719 | A | * | 12/1898 | Mason | 42/75.02 |
| 1,065,341 | A | * | 6/1913 | Browning | 42/75.02 |
| 1,347,756 | A | * | 7/1920 | Payne | 89/185 |
| 1,370,836 | A | * | 3/1921 | Nelson | 42/17 |
| 1,864,374 | A | * | 6/1932 | Hermann et al. | 42/76.01 |
| 2,110,165 | A | * | 3/1938 | Moore | 42/75.02 |
| 2,279,931 | A | * | 4/1942 | Swebilius | 42/75.01 |
| 2,995,127 | A | * | 8/1961 | Orr | 123/179.8 |
| 3,057,264 | A | * | 10/1962 | Walton | 409/261 |
| 3,786,977 | A | * | 1/1974 | Shamaly | 227/8 |
| 3,895,829 | A | * | 7/1975 | Manson, Jr. | 285/3 |
| 4,402,152 | A | * | 9/1983 | Casull | 42/16 |
| 4,644,930 | A | * | 2/1987 | Mainhardt | 124/58 |
| 5,020,260 | A | * | 6/1991 | Houghton | 42/75.02 |
| 6,295,751 | B1 | * | 10/2001 | Piwonski | 42/1.15 |
| 6,571,676 | B1 | * | 6/2003 | Folsom et al. | 89/17 |
| 6,591,534 | B1 | * | 7/2003 | Trudeau et al. | 42/75.02 |
| 6,594,936 | B1 | * | 7/2003 | Sniezak et al. | 42/76.02 |
| 6,752,061 | B2 | * | 6/2004 | Knorich et al. | 89/14.05 |
| 2004/0200346 | A1 | * | 10/2004 | Baumann et al. | 89/14.05 |
| 2006/0065110 | A1 | * | 3/2006 | Ireland et al. | 89/17 |
| 2008/0168695 | A1 | * | 7/2008 | Nakayama | 42/75.02 |

FOREIGN PATENT DOCUMENTS

| | | |
|---|---|---|
| DE | 199 18 303 | 11/2000 |

* cited by examiner

*Primary Examiner* — Bret Hayes
*Assistant Examiner* — Joshua Freeman
(74) *Attorney, Agent, or Firm* — Lucas & Mercanti, LLP; Klaus P. Stoffel

(57) ABSTRACT

A gun barrel with a gun barrel liner and a breech ring, which are joined with each other by a bayonet thread. A continuous cavity is left between adjacent bayonet ridges of the gun barrel liner and the bayonet ridges of the breech ring that are located axially behind them or in front of them. A locking segment is inserted in at least one of the cavities that is formed in the installed gun barrel liner between adjacent bayonet ridges of the gun barrel liner and the bayonet ridges of the breech ring to prevent unintentional detachment of the gun barrel liner from the breech ring. The locking segment can completely fill the corresponding cavity.

5 Claims, 3 Drawing Sheets

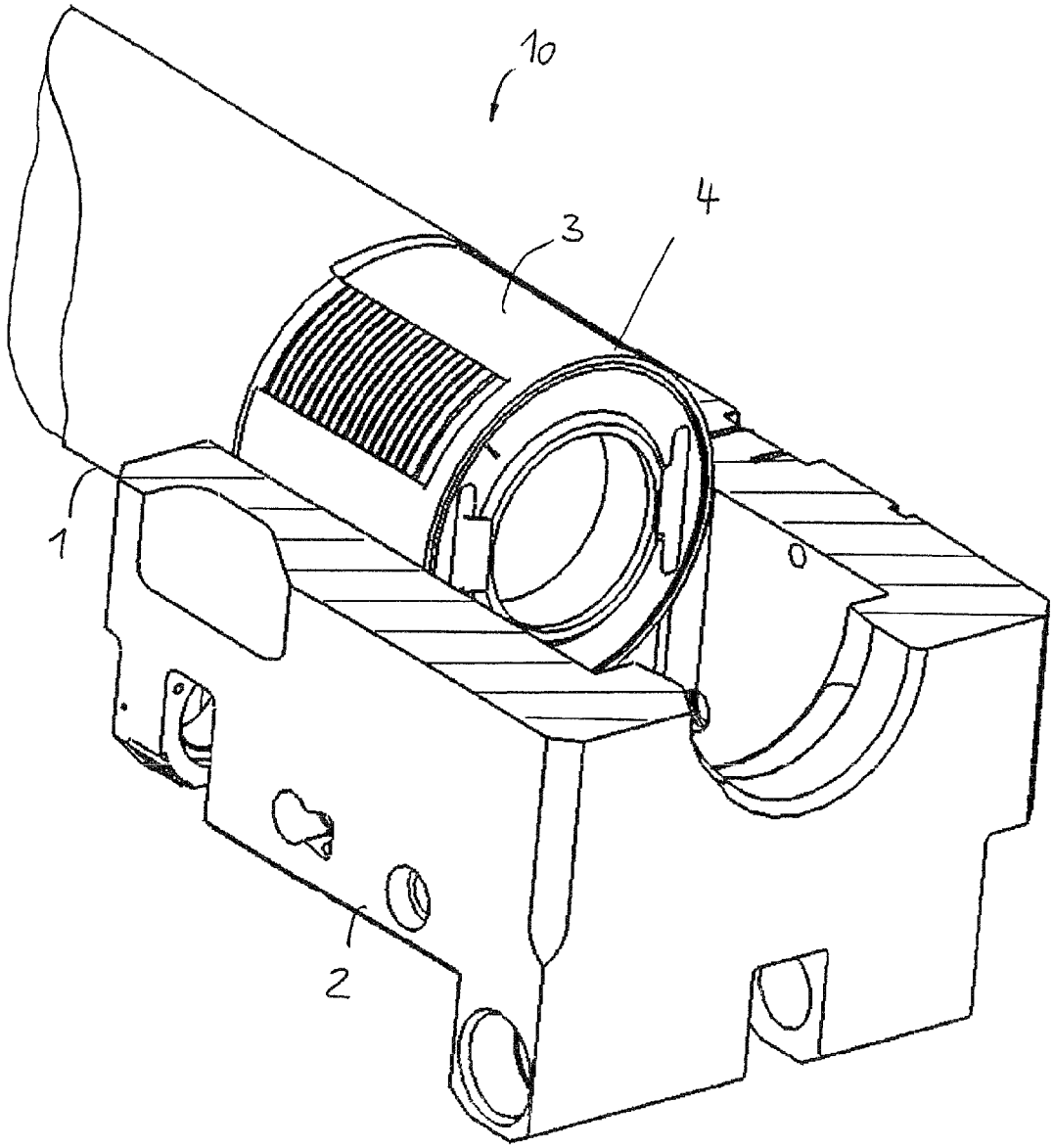
Fig. 1
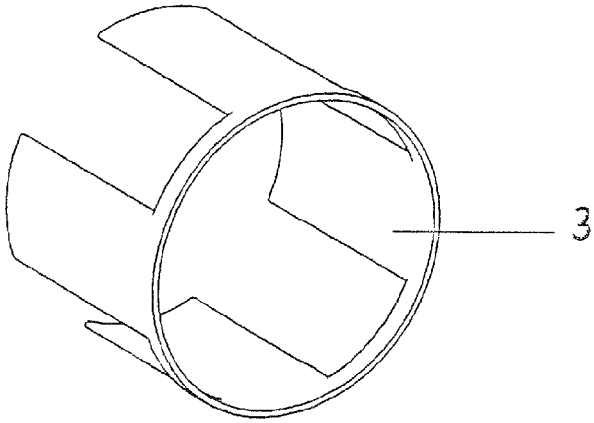

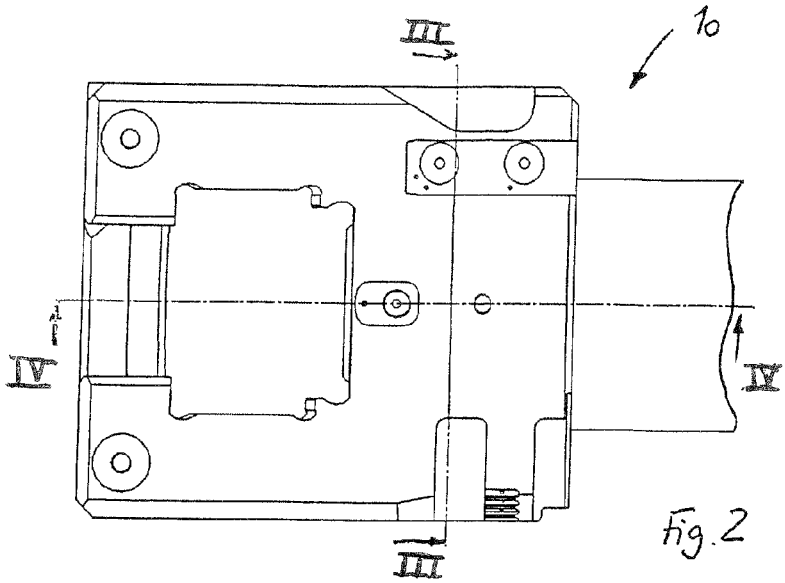
Fig. 2
Fig. 3
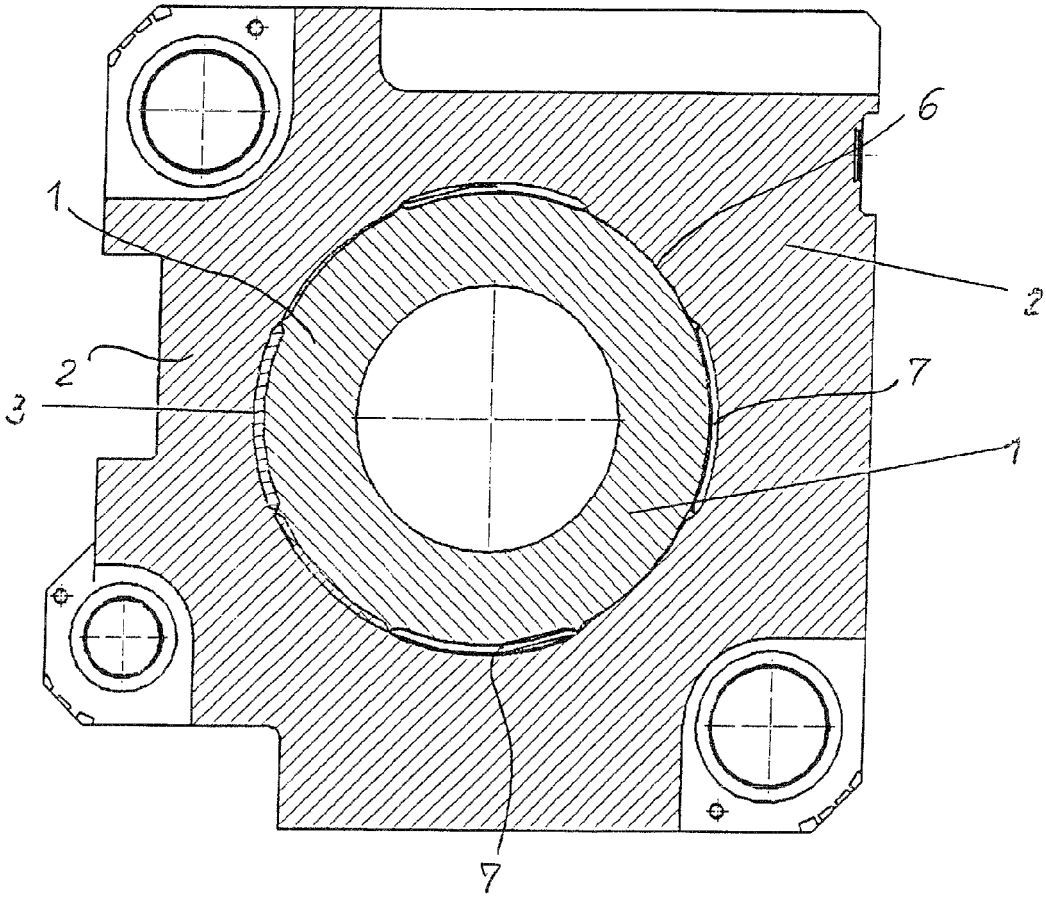

GUN BARREL

BACKGROUND OF THE INVENTION

The invention concerns a gun barrel with a gun barrel liner and a breech ring, which are joined with each other by a bayonet thread, wherein a continuous cavity is left between adjacent bayonet ridges of the gun barrel liner and the bayonet ridges of the breech ring that are located axially behind them or in front of them.

In large-caliber gun barrels, the breech ring, which contains the breech mechanism, is usually screwed onto the rear-end region of the gun barrel liner to make it possible, when necessary, to change the gun barrel. In previously known gun barrels, in order to prevent, especially when a bayonet screw joint (DE 199 18 303 C2) is being used, unintentional unscrewing of the liner from the breech ring and in order to transmit to the breech ring the spin torques that develop during firing from a rifled barrel, the gun barrel liner is provided with a groove, into which a feather key fits, which feather key is installed in the breech ring of the gun.

A disadvantage associated with the use of this type of locking mechanism is that the groove milled into the gun barrel liner for transmitting the torque to the breech ring causes weakening of the liner, so that the service life of the liner is reduced or the tube outside diameter of the gun barrel liner must be selected larger than for liners without a groove of this type.

SUMMARY OF THE INVENTION

The object of the invention is to provide a gun barrel of the aforementioned type, in which, despite the use of a bayonet thread for joining the gun barrel liner and the breech ring, unintentional detachment of the gun barrel liner from the breech ring is reliably prevented by simple means.

The invention is based essentially on the idea of inserting a locking segment in at least one of the cavities formed in an installed gun barrel liner between adjacent bayonet ridges of the liner and the breech ring, such that the locking segment is intended to completely fill the given cavity. Depending on the specific embodiment, after the installation of the gun barrel liner, this locking segment can be pushed into the corresponding breech ring from behind (i.e., through the breech chamber of the breech ring) or from the front.

The segments can also be positioned continuously on a ring.

This has the advantage that no additional groove or bore is needed in the gun barrel liner. The spin torques that develop during firing from a rifled barrel are transmitted by this locking mechanism from the barrel to the breech ring, i.e., the spin torque acting on the barrel is laterally transmitted from the bayonet ridge of the barrel through the segment and to the bayonet ridge of the breech ring.

Additional details and advantages of the invention are apparent from the following description of the invention in connection with the drawings.

BRIEF DESCRIPTION OF THE DRAWINGS

FIG. 1 is a perspective view of a barrel and a breech ring with a segmented ring.

FIG. 2 is a top view of the barrel with breech ring from FIG. 1.

FIG. 3 is a sectional view of the barrel and breech ring along line III-III in FIG. 2, perpendicular to the axis of the barrel.

DETAILED DESCRIPTION OF THE INVENTION

Figure 4:
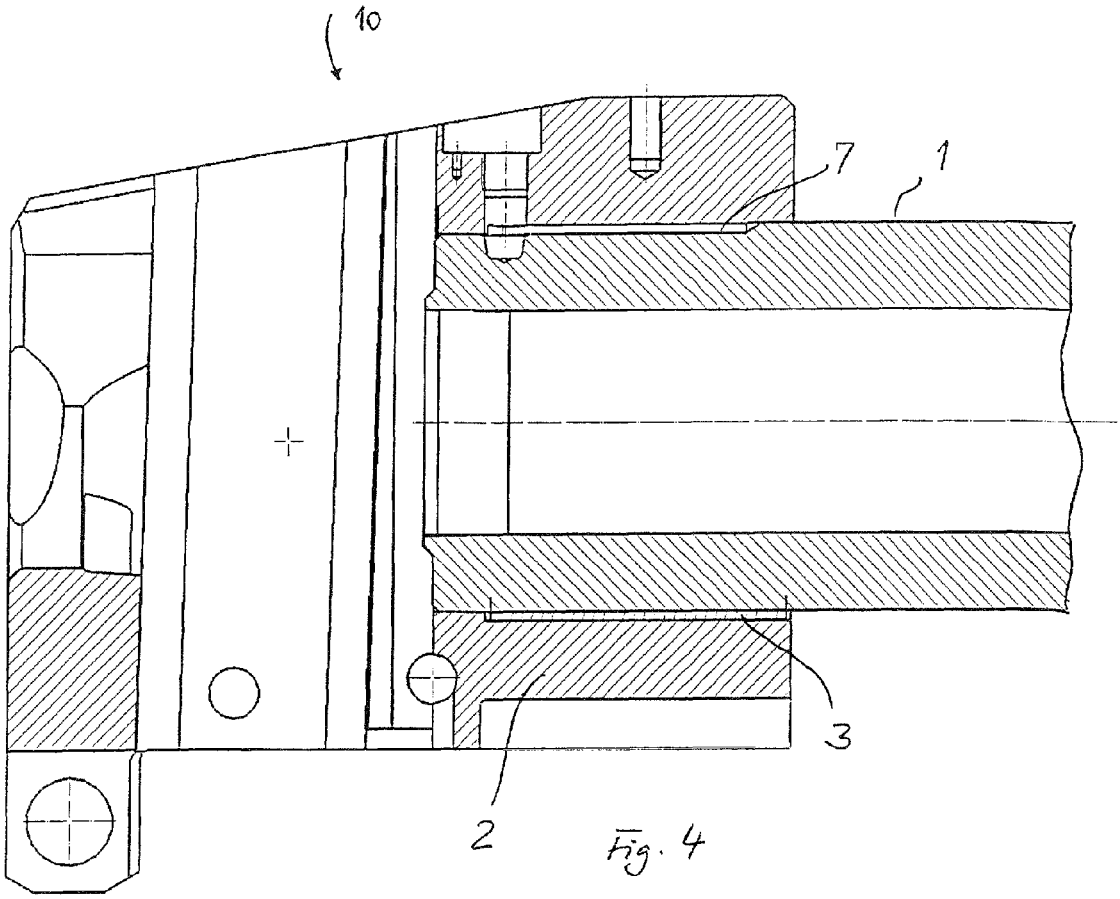
FIG. 4 is a sectional view along line IV-IV in FIG. 2.

FIG. 1 shows a perspective view of a gun barrel 10 with a gun barrel liner 1 and a breech ring 2, wherein locking segments 3 are fixed in place around the gun barrel liner 1 in the rear section or at the rear end. The segments 3 are held together in this drawing by a segmented ring 4 to form a unit, although this is not required.

FIG. 2 shows a top view of the gun barrel 10.

FIG. 3 shows the section III-III perpendicular to the barrel axis of the gun barrel liner 1 located in the breech ring 2. The gun barrel liner 1, which is provided with grooves and lands for firing spin-stabilized projectiles (not shown), and the breech ring 2 are connected with each other by a bayonet thread. In the section reproduced here, only the bayonet ridges 6 of the gun barrel liner 1 can be seen.

Cavities 7 are present in the breech ring 2 between adjacent bayonet ridges 6 of the gun barrel liner 1 (and thus between the bayonet ridges of the breech ring 2 as well, which are aligned behind or in front of the bayonet ridges of the gun barrel liner in the axial direction of the barrel).

In accordance with the invention, it is now provided that a locking segment 3 is inserted in at least one of these cavities, which locking segment 3 preferably completely fills the cavity 7 between the bayonet ridges 6 of the gun barrel liner 1 and the bayonet ridges (not shown) of the breech ring 2, so that when a, for example, spin-stabilized, projectile is discharged, the spin torque acting on the gun barrel liner 1 is completely transmitted by the locking segment 3 from the bayonet ridge 6 of the gun barrel liner 1 to the corresponding, axially adjacent bayonet ridge of the breech ring 2, and torsion of the gun barrel liner 1 relative to the breech ring 2 is not possible.

FIG. 4 shows a sectional drawing along line IV-IV in FIG. 2. The individual locking segment 3 is pushed in from the front via a recess in the gun barrel liner 1 into the free space or cavity 7 between the gun barrel liner 1 and the breech ring 2.

The locking segment 3 is fixed in place with the segmented ring 4 through the opening in the breech ring 2, in which the sliding breechblock is later located. The one or more locking segments 3 are inserted into the free space or cavity 7. In its installed state, the segmented ring 4 in turn disappears in a recess at the end of the receiving bore for the gun barrel liner 1.

It has been found to be advantageous for locking segments 3 to be mounted in several or all cavities 7 between bayonet ridges.

Although the present invention has been described in relation to particular embodiments thereof, many other variations and modifications and other uses will become more apparent to those skilled in the art. It is preferred, therefore, that the present invention be limited not by the specific disclosure herein, but only by the appended claims.

The invention claimed is:

1. A gun barrel assembly, comprising a gun barrel; a breech ring, the gun barrel and the breech ring being joined with each other by a bayonet thread so that a continuous cavity is left between adjacent bayonet ridges of the gun barrel and bayonet ridges of the breech ring that are located axially behind or in front of the bayonet ridges of the barrel; and a locking segment inserted in at least one of the cavities between adjacent bayonet ridges so as to at least partially fill the cavity, wherein the locking segment completely fills the cavity.

2. The gun barrel in accordance with claim 1, wherein a plurality of the locking segments positioned continuously on a ring are inserted in several cavities.

3. The gun barrel in accordance with claim 1, wherein the locking segment is inserted on a side of a breech mechanism into a corresponding cavity.

4. The gun barrel in accordance with claim 1, wherein the gun barrel is a rifled gun barrel that is suitable for firing spin-stabilized projectiles.

5. The gun barrel in accordance with claim 1, and further comprising a segmented ring arranged to hold the locking segment.

* * * * *